United States Patent [19]

Colacci et al.

[11] Patent Number: 4,838,326

[45] Date of Patent: Jun. 13, 1989

[54] LINEAR VOLUMETRIC SYSTEM WITH AUTOMATIC LATCHING MEANS FOR CLAMPING TOGETHER ADJACENT FILLER CYLINDERS

[75] Inventors: John R. Colacci, Pennsauken; James L. Nesbitt, Jr., Willingboro, both of N.J.

[73] Assignee: Campbell Soup Company, Camden, N.J.

[21] Appl. No.: 113,990

[22] Filed: Oct. 29, 1987

[51] Int. Cl.[4] ..... B65B 43/42; B67C 3/02

[52] U.S. Cl. ..... 141/147; 141/258; 141/163

[58] Field of Search ..... 141/129, 135, 137, 144, 141/145, 146, 147, 163, 181, 183, 250, 258, 270, 284; 53/381 A, 381 R

[56] References Cited

U.S. PATENT DOCUMENTS

| | | | |
|---|---|---|---|
| 970,283 | 9/1910 | Wilfley | 209/432 |
| 2,987,165 | 6/1961 | Sheehan | 198/140 |
| 3,107,703 | 10/1963 | Smith | 141/86 |
| 3,168,225 | 2/1965 | Miller et al. | 141/147 |
| 3,378,173 | 4/1968 | Minard | 141/147 |
| 3,587,671 | 6/1971 | Gamberini | 141/67 |
| 3,656,517 | 4/1972 | Taylor et al. | 141/1 |
| 3,731,715 | 5/1973 | Gageant et al. | 141/107 |
| 3,847,191 | 11/1974 | Aronson | 141/12 |
| 4,627,475 | 12/1986 | von Lersner | 141/258 X |

*Primary Examiner*—Ernest G. Cusick
*Attorney, Agent, or Firm*—Albert L. Free

[57] ABSTRACT

Apparatus for filling containers from individual volumetric dispensers as both move rapidly along a straight-line path. The dispensers are moved in a closed loop and filled while travelling along another straight-line path opposite the dispensing straight-line path, by forcing flowable product upwardly into the open lower ends of the dispensers as they slide over a filler slot. To prevent flow of the product upward between the dispensers, a mechanism is provided which automatically locks the ends of the adjacent dispensers against each other to provide a seal against inter-dispenser product flow, and which automatically decouples the containers after their filling so they can turn with respect to each other, as is necessary as they negotiate curves in the closed-loop path along which they travel.

8 Claims, 7 Drawing Sheets

LINEAR VOLUMETRIC SYSTEM WITH AUTOMATIC LATCHING MEANS FOR CLAMPING TOGETHER ADJACENT FILLER CYLINDERS

FIELD OF THE INVENTION

This invention relates to systems for the delivery of product into containers, and particularly for the delivery of product from moving product dispensers into moving containers.

BACKGROUND OF THE INVENTION

It is often desirable to be able to fill successive containers with product automatically, rapidly, neatly and with a predetermined amount of product.

For well-known and obvious reasons, the containers to be filled preferably move rapidly in a continuously-moving series train, rather than stopping to be filled and then starting up again. It is also often desirable to employ a so-called volumetric filler for this purpose, which uses a cylinder containing a piston to dispense a predetermined amount of product upon each stroke of the piston.

One form of such apparatus is described and claimed in U.S. Pat. No. 3,731,715 of L. M. Gageant and William L. Greet, issued May 8, 1973 and originally filed May 29, 1969, which is of common assignee herewith. It comprises a so-called rotary-turret volumetric filler, in which the containers are filled while moving in a circle, with the dispensers moving in a circle above them. In such apparatus the containers are forced to deviate from a straight-line path on an input conveyor so as to enter the circular path for filling, and to resume a straight-line path upon their exit from the rotary filler.

In such a rotary volumetric filler, it is also known to empty the dispenser cylinders into the containers as they move along one part of their circular path as described above, and to fill the dispenser cylinders with product while they are traversing a different part of their path. Filling may be accomplished by sliding the lower open ends of the dispenser cylinders along a feed plate containing a slot-like opening in its top, through which the product is fed into the lower ends of the cylinders from a chamber below the slot, as a piston in each cylinder is drawn upwardly. A continuous sealing surface is also provided between the cylinders, which moves with the cylinders and in contact with the feed plate, so that the product cannot rise upwardly through the slot and between the cylinders.

Another form of rotary filler is described in application Ser. No. 768,352 of W. A. von Lersner, filed Aug. 22, 1985, issued as U.S. Pat. No. 4,627,475 on Dec. 9, 1986, and of common assignee herewith.

While effective for its intended purposes, the rotary filler is limited with respect to the rate at which it can fill containers accurately and neatly at a high rate, since the containers must be diverted from a straight-line path, moved along a circle, and then returned to a straight-line path, operations which involve accelerations of the container and hence tend to produce spillage at high rates of operation.

While so-called "linear" systems which dispense product into containers as they move along a straight line are known, there do not appear to have been systems of this class which can be used effectively using high-speed volumetric fillers or the like.

Accordingly, it is an object of the invention to provide a new and useful linear filler system.

Another object is to provide such a linear filler system system using volumetric fillers.

A further object is to provide such a system which operates rapidly and accurately, with substantially no tendency to spillage of product even when operated at high rates.

Still another object is to provide such a linear filler system in which filling is accomplished by feeding product into the lower ends of the dispenser cylinders through an opening over which they slide as product is supplied to the opening from below the slot, while preventing product from being fed upwardly between the cylinders.

SUMMARY OF THE INVENTION

These and other objects of the invention are achieved by the provision of a system in which product dispensers are moved in a continuous closed orbit or loop, the loop having a substantially-straight first portion which runs along a straight section of the container conveyor. While the dispensers and containers are thus moved along in adjacent parallel straight lines, the product is dispensed into the containers. Because the containers are travelling in a straight line, they can be moved and filled reliably and accurately by the dispensers, even though moving at a high rate of speed.

In the preferred embodiment, the dispensers are cylinders filled as their open ends slide over a product feed slot while moving through another part of their orbit, as is also the case in the rotary volumetric filler of the above-cited patent. However, in the subject linear filler, a special problem is encountered with respect to the unwanted feeding of product upward through the feed slot and between dispenser cylinders, which is as follows.

While in the rotary filler the dispensers move in a circle and hence can be rigidly and continuously secured to each other by a flat surface which prevents undesired leakage of product from the feed slot upward between cylinders, in the linear filler of this invention the non-circular loop through which the dispensers move requires that they not be rigidly joined together. Accordingly, in accordance with a preferred form of the invention, the product dispensers are separately mounted so that they can turn with respect to each other, as is required when the curvature of their path changes—e.g. in going from a straight line section of the loop to a curved section. The lower side portions of each dispenser are provided with surfaces so shaped as to serve as sealing shoes forming a seal when clamped against corresponding lower side portion of its neighbors while traversing the feed slot, so as to prevent product from being fed upwardly between dispensers. Preferably the dispensers are automatically urged sealingly together at the beginning of traversal of the feed slot by first cam means moving latch means on each cylinder into latching engagement with latch-engaging means on the neighboring cylinder, and are released from each other by second cam means acting on the latch means after traversal of the slot is complete.

It will be understood that, as used herein, unless clearly indicated otherwise, the term "cylinder" means a body containing a cylindrical opening for receiving product, and does not means that the body is cylindrical at its outer surface.

Preferably, although not necessarily, the loop along which the dispensers travel is horizontal and the feed slot is substantially straight, as is the portion of the conveyor loop extending along the slot, the entire conveyor loop then having the form of two straight, spaced-apart, parallel sections joined by a pair of semicircular end portions.

BRIEF DESCRIPTION OF DRAWINGS

These and other objects and features of the invention will be more readily understood from a consideration of the following detailed description, taken with the accompanying drawings, in which.

DESCRIPTION OF PREFERRED EMBODIMENTS

Figure 1:
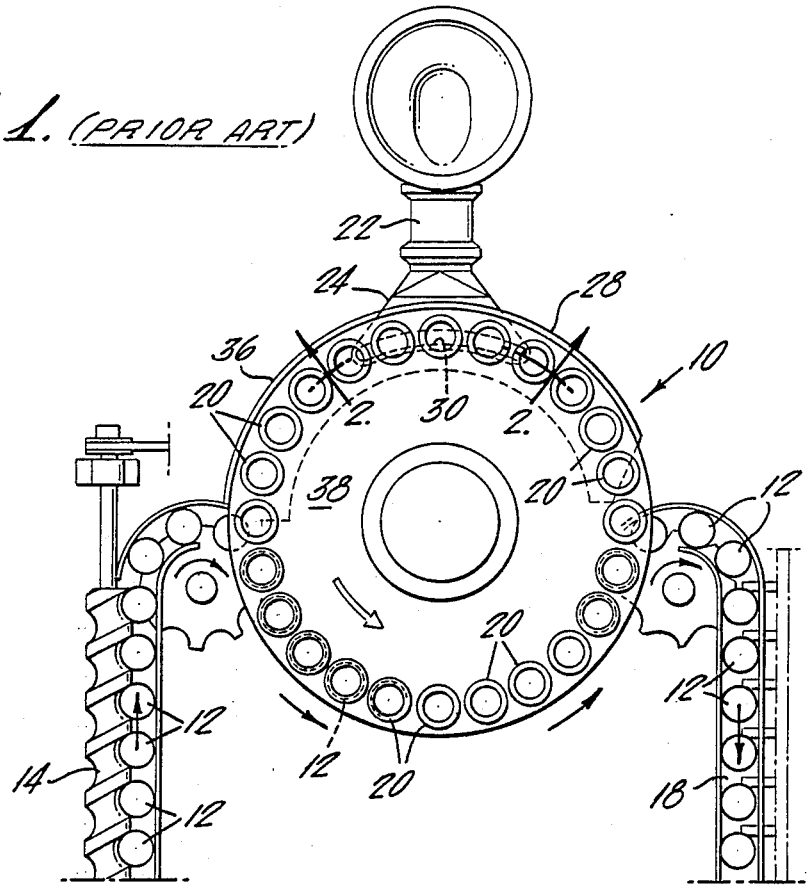
Fig. 1. (PRIOR ART)
FIG. 1 is a schematic top plan view of portions of a rotary filler of the prior art.
Figure 2:
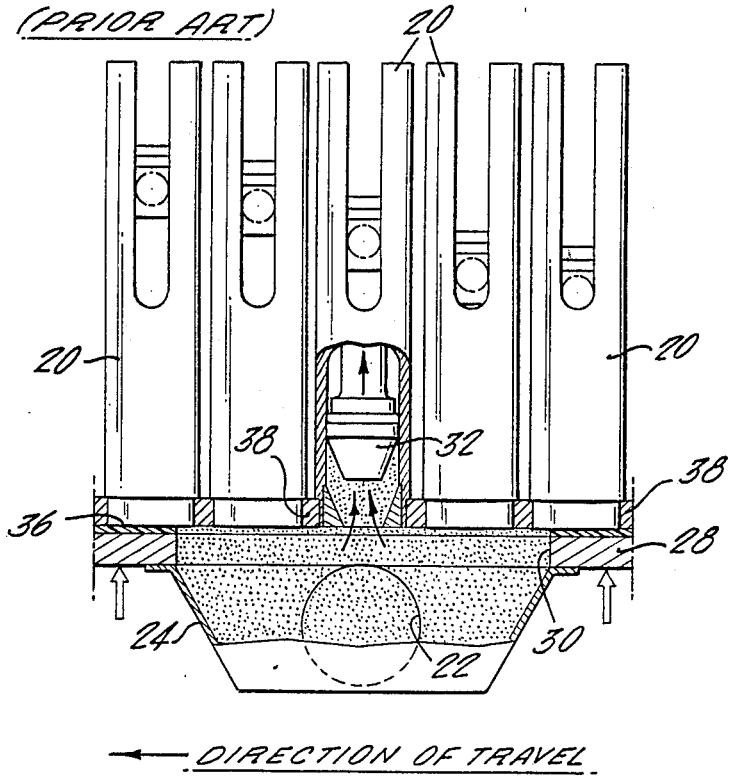
Fig. 2. (PRIOR ART)
FIG. 2 is an elevational sectional view taken along lines 2—2 of FIG. 1.

Turning now to FIGS. 1 and 2 showing a rotary filler 10 of the prior art, the containers 12 (shown as cylindrical cans) are continuously delivered to the filler by a screw conveyor 14 and carried away from the filler by an output conveyor 18. In the filler the cans are conveyed along a circular path beneath a circular array of volumetric dispenser cylinders such as 20 moving at the same speed as the cans. The food product is supplied in flowable form (e.g. soup, in this instance) through an inlet 22 to a product reservoir 24 beneath the lower ends of the cylinders, under a head of pressure. Overlying the reservoir is a feed plate 28 having a circumferentially-extending slot 30 in it, as shown.

As is seen most readily in FIG. 2, each cylinder 20 contains a piston 32 which is drawn upwardly, by cam means not shown in this view, as the cylinder moves over the slot 30, to permit product to enter the lower end of the cylinder by way of the feed slot 30. The lower end of each piston bears downwardly against the top of a slide plate 36 on top of the feed plate 28, to provide a good liquid seal while facilitating the sliding of the lower ends of the cylinders over the plate. In this way, each cylinder is fed with product at its bottom end as it passes over the feed slot, and is sealed off to prevent loss of product by the seal provided between the lower end of each cylinder and the top of the slide plate 36, until the cylinder reaches the end of the slide plate and dispenses the product into the cans by appropriate downward motion of the piston within the cylinder.

A system of this general class is described in the above-cited patents. In the prior-art system shown, it is noted that product is prevented from being delivered upwardly through the feed slot and between the cylinders by terminating the lower ends of all cylinders in a single rotating ring 38 which extends around and between the cylinders, and completely around the circular array of cylinders, with its lower side flush with the lower ends of the cylinders, to seal off the top of the feed slot except where the open ends of the cylinders are located above the feed slot.

Figure 3:
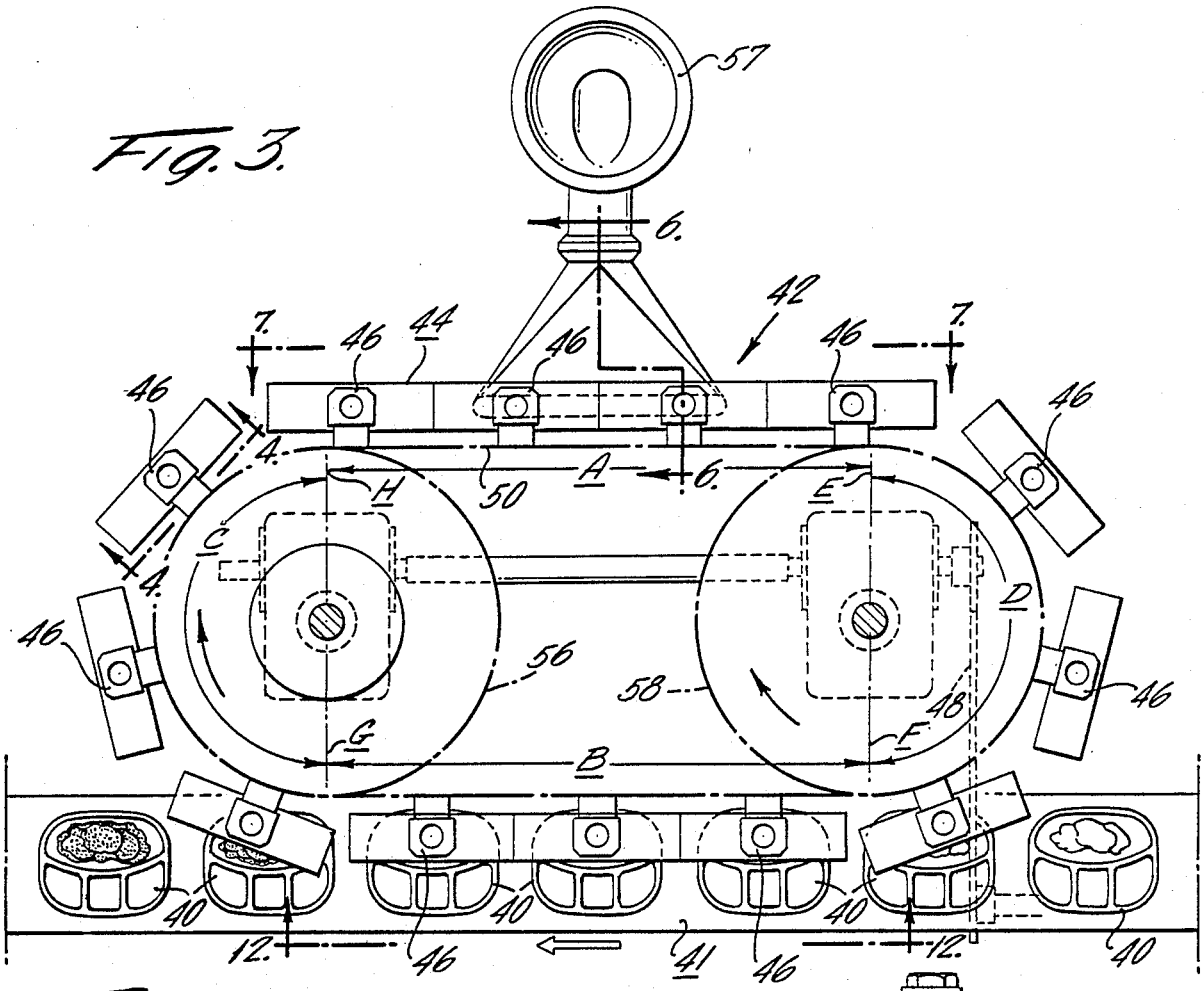
FIG. 3 is a schematic top plan view of a preferred embodiment of the present invention, to which reference will be made in explaining certain problems solved by the present invention, and from which details shown in other figures are omitted for clarity.

FIG. 3 shows, in contrast, a system of the class employed in the present invention, in which the path of the cylindrical dispensers is non-circular, i.e. its curvature is non-uniform. As a result, the angular position of each dispenser with respect to its neighbors changes wherever there is a change in curvature of path.

For example, in FIG. 3 the dispensers maintain the same relative angle as they traverse the straight section A where filling of the dispenser occurs, and as they traverse the straight section B where the product is dispensed into the containers (in this case trays 40). There is also a constant relative angle between the dispensers traversing each circular end of the loop, as at C and D. However, at each transition between a straight-line path and a circular path, as at E,F,G and H, there is a change in curvature of path and the angle between adjacent dispensers changes.

More particularly, in the preferred embodiment of the invention shown in the drawings by way of example only and without thereby in any way limiting the scope of the invention, containers such as 40, which may be frozen-food trays for example, move along a straight-line path in the direction of the arrow, on a straight-line conveyor 41 of conventional form. The containers are spaced apart by a fixed predetermined distance in known manner, and move at a predetermined rate coordinated with the speed of the filler 42.

The filler 42 is located adjacent the straight-line conveyor 41, and includes a horizontally-moving closed-loop dispenser conveyor 44 carrying dispensers such as 46 in such manner that each dispenser move in a straight line above each of the containers 40 during a portion of its orbitting motion, as shown particularly clearly in FIG. 3, so that product can be dispensed downwardly into the containers from the dispensers as they move along in a straight line above the containers. In order to maintain this relationship, the drives for the container conveyor and for the drive for the dispenser conveyor are preferably directly synchronized with each other by means of a suitable and conventional chain drive 48.

Figure 5:
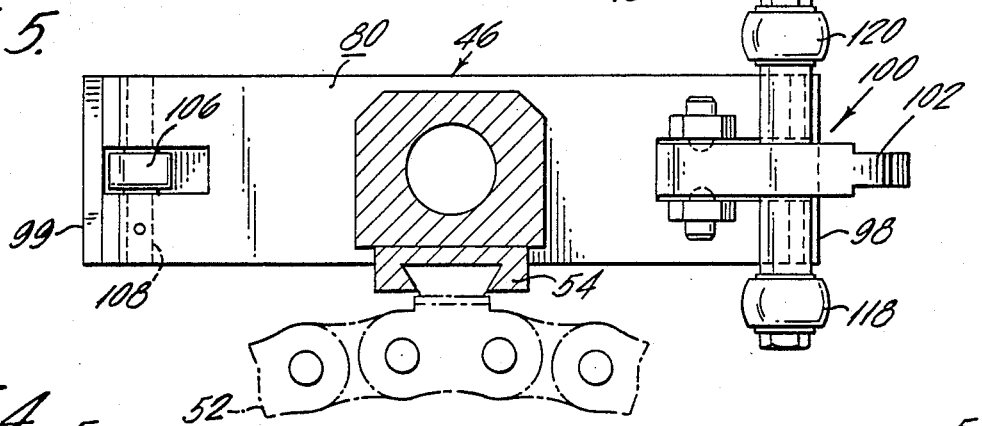
FIGS. 4 and 5 are enlarged side and top views of a portion of the system of the invention, illustrating a preferred arrangement for clamping and unclamping the product dispensers to and from each other.

The dispenser conveyor preferably comprises a pair of vertically spaced-apart chains 50 and 52 (FIG. 6), to which the cylinders are secured by vertical dovetail arrangements such as 54 (FIGS. 5 and 6), which permit the cylinders to slide up and down with respect to the chains. Preferably the chain drive is provided by a first pair of upper sprocket wheels 56 and 58 and by a second parallel pair of lower sprocket wheels 56A and 58A, the wheels of each pair being positioned at opposite ends of the loop formed by the dispenser conveyor, so that the straight-line section A of the dispenser conveyor is provided opposite the straight-line portion B which carries the dispensers during the dispensing action. Filling of the dispensing cylinders is accomplished during traversal of this straight run A of the dispenser conveyor, as will now be described.

Product stored in a storage hopper 57 is supplied by gravity to the product reservoir 59 located beneath the path of the lower open ends of the dispenser cylinders. The latter reservoir communicates with the feed slot 60 which extends through the top feed plate 62 and top slide plate 64, and along the path of the lower ends of the dispenser cylinders. Each dispenser cylinder is filled by product which is urged upwardly through the feed slot 60 into the open bottom ends of the cylinder as it passes over the slot. Motion of the product upward through the feed plate and into the cylinder may be provided entirely by gravity feed, or by the suction exerted by upward motion of the piston 65 within the dispenser cylinder, or preferably by both.

The pistons such as 65 contained in each cylinder are caused to move upwardly and downwardly at appropriate times to accomplish filling and dispensing. To provide the desired motion of the pistons, a camming arrangement is provided around the path which the dispenser cyinders take in traversing the closed loop.

Figure 7:
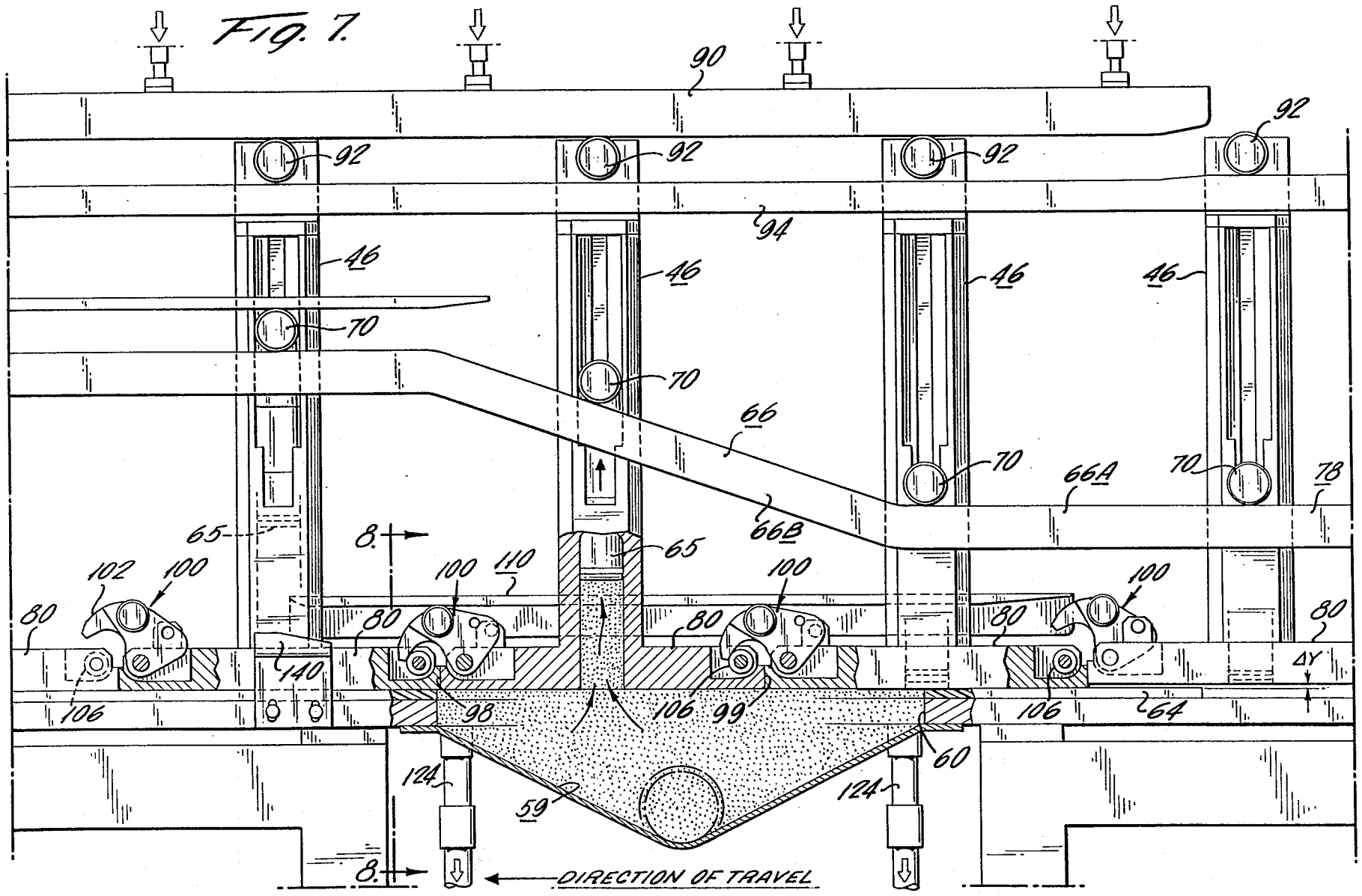
FIG. 7 is an enlarged fragmentary, side elevational view taken along lines 7—7 of FIG. 3, showing the straight-line section of the system along which product is delivered into the dispenser cylinders from the feed slot.

More particularly, as shown in FIG. 7 the cam track 66 has a lower portion 66A, which holds the cam followers such as 70 on the cylinders in a corresponding lower position when approaching the feed slot, followed by an upwardly-sloping portion 66B which lifts the piston to its upwardly-withdrawn position, thereby to accomplish filling of the cylinder with the product from the underlying feed slot.

As shown at the left in FIG. 7, when the lower end of a cylinder has passed beyond the end of the feed slot 60, it is closed off by the slide plate 64 while the cylinder cam follower 70 remains at a dwell position for which the piston remains withdrawn to its maximum height. When the dispenser cylinder has moved to a position above the container which it is to fill, the cam follower follows a discharge cam track 76 which slopes downwardly to a lower position such that the piston in the cylinders is moved downwardly, to discharge product into the corresponding underlying container as the dispenser moves with and above the container. In this example, the trays may contain dinners to be frozen, and the dispensed product may be gravy.

Figure 12:
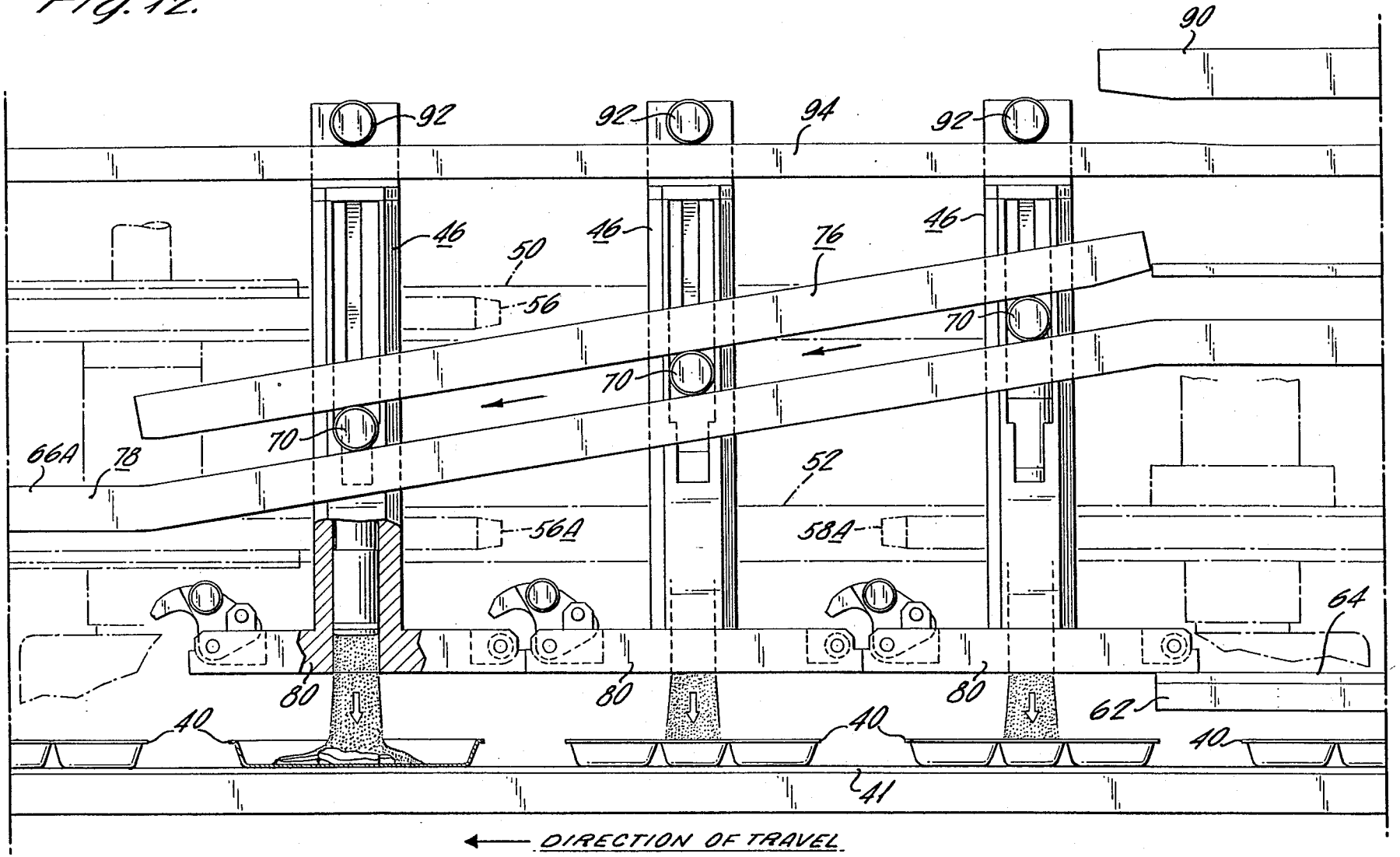
FIG. 12 is a side elevational view taken along lines 12—12 of FIG. 3, showing the straight-line portion of the system along which the product is dispensed into the moving container.

At the extreme left of FIG. 12 the cam follower 70 has descended onto cam track 78 and the pistons assume their lowest positions. The cam track and the pistons remain substantially at this level until the cylinders have again moved to the "fill" position above the feed slot 60 (FIG. 7), at which time the cam followers rise as previously described to raise the pistons and fill the cylinders with product.

Such an arrangement is commonly designated as a volumetric filler, because the exact amount of product picked up by the dispenser and discharged into the containers is fixed and predetermined, although it may be adjusted as desired. That is, since the piston is moved upwardly to a predetermined position while the cylinder is filled, a predetermined amount of product equal to the volume of the cylinder below the piston is placed into the cylinder, and when the piston is later moved downwardly to empty the cylinder completely, this predetermined amount of product is discharged into the corresponding container.

Figure 11:
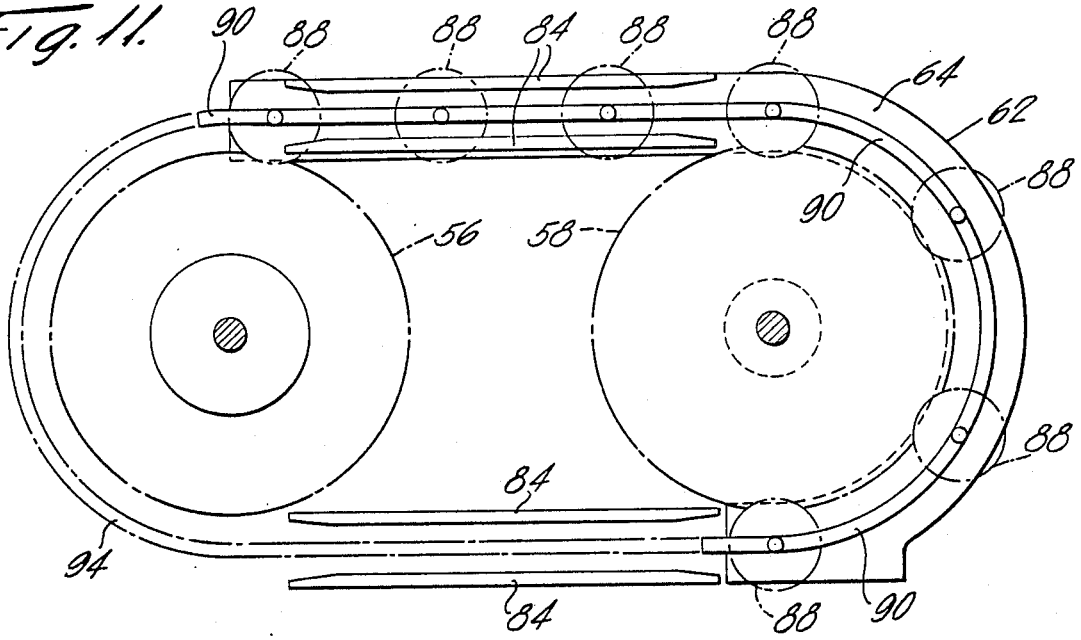
FIG. 11 is a plan view taken on lines 11—11 of FIG. 10, showing particularly the arrangement of the sprocket wheels and chains.
Figure 10:
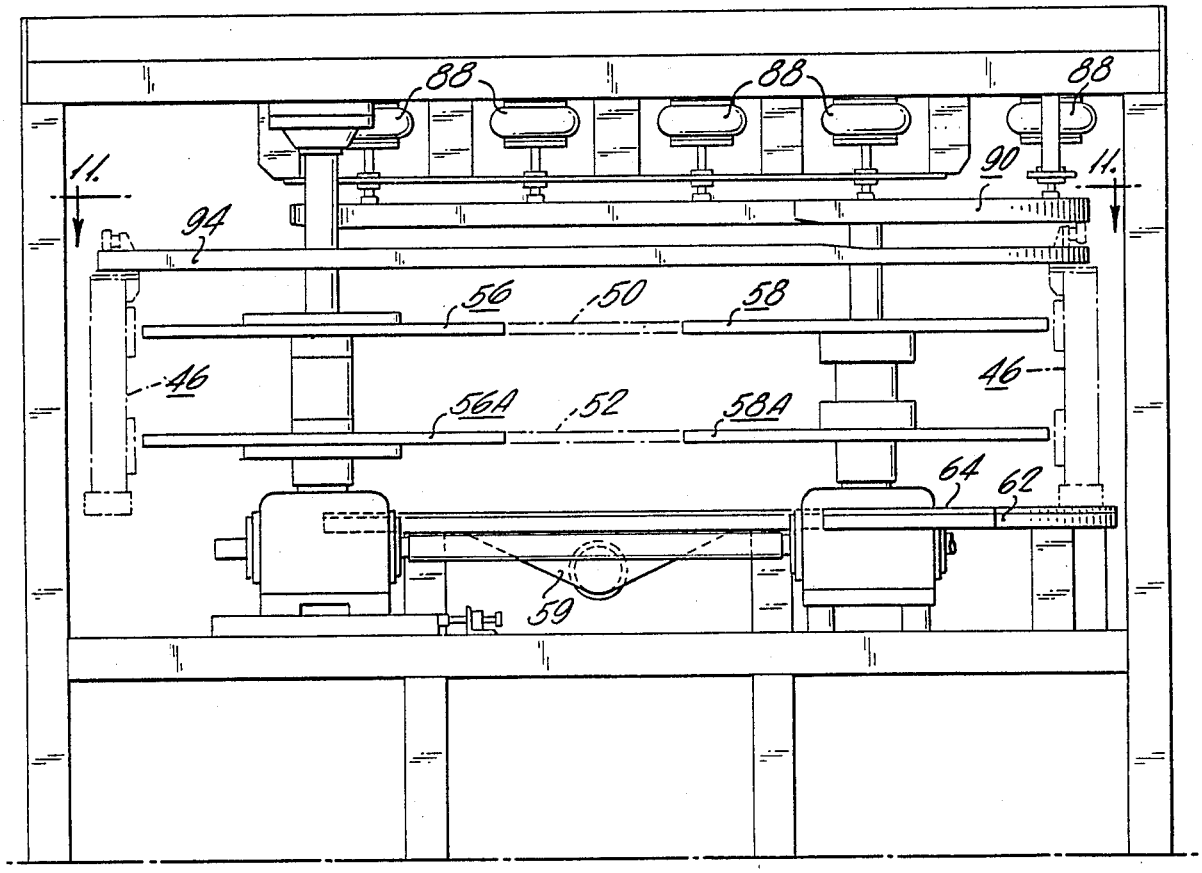
FIG. 10 is aside elevation view embracing the entire system, but with parts omitted to show particularly clearly the drive, biasing and camming-rail system generally.

In order to assure good sealing of the feed slot from the environs as each cylinder passes over it, in accordance with the invention the lower end of each dispenser cylinder comprises a flange portion 80 serving as a sealing shoe, which extends laterally beyond the width of the feed slot as described more fully hereinafter. Frame-mounted guides such as 84 are also preferably utilized (see FIGS. 6 and 11), extending laterally adjacent the sides of the sealing shoes and serving to stabilize the lateral positions of the lower ends of the cylinders as they move along their paths near the filling and dispensing stations.

Further to ensure proper sealing, the dispenser cylinders themselves are preferably urged downwardly against the feed plate by a set of air springs such as 88 (FIG. 6), which urge top cam rail 90 downwardly against the cam follower 92, the latter cam follower being secured to the dispenser cylinder to urge it downwardly during the intake cycle. Cam follower 92 is in this phase of operation held in a position spaced slightly above a lower cam rail 94 due to the limitation of downward motion of the cylinder by bearing of its lower end against slide plate 64. This sealing action is maintained during the dwell phase which follows filling of the dispenser cylinders but, during the discharge phase when there is no feed plate for the lower end of the cylinder to bear against, the cam rail 94 supports the cam follower 92. In this latter phase, the cam follower is out of contact with the downwardly-biased cam rail 90, and is supported by the slightly elevated cam rail 94. This condition continues during the return of the cylinder to the feed plate following discharge of product, as shown in FIG. 7, until the cam rail 90 lowers the cylinder into the position previously described with respect to FIG. 7, in which it is urged downwardly against the top of the feed plate by the air springs.

As will be appreciated particularly from FIG. 3, the dispenser cylinders, in orbitting about their closed-loop path, travel through two straight-line sections in which the cylinders are all aligned with each other, and through two semicircular end sections in which they are not aligned with each other; at any point in their orbit where the curvature of their path changes, the angular positions of the cylinders about their verticl axes change with respect to their immediate neighbors. In the present embodiment, this occurs wherever the path of the dispensers changes from a straight line to a semicircular configuration, or vice versa. Accordingly, the dispensing cylinders, and anything secured to them which moves with them, must be free to rotate with respect to its neighbor in order to traverse the closed loop. Referring to FIG. 3, for example, it will be seen that when the cylinders are traversing the straight-line discharge path, or the straight-line filling path, they are in the same relative angular rotation with respect to each other, while when they traverse the two semicircular end portions of the loop they are at different angular orientations with respect to each other.

This is in contrast to the situation which exists in the usual rotary conveyor of the above-cited Gagent et al patent wherein, because of the purely circular motion of the cylinders, they maintain the same angular configuration with respect to each other. Accordingly, in the rotary filler of the Gageant et al patent, each cylinder is rigidily attached to its neighbor by a plate having a lower surface which covers and slides over the feed slot to seal off the space between the intake openings of the cylinders, and thus prevent the product in the product feed chamber from moving upwardly through the feed slot and between the cylinders to contaminate the feed plate and the adjacent apparatus with waste food product.

In the system of the invention, the cylinders cannot be fixedly secured to each other since they must be free to turn with respect to each other about a vertical axis as described above. This creates the problem that, with the cylinders only loosely attached or not attached at all to each other as they pass over the feed slot, the food product will in fact leak upwardly through the feed slot between cylinders to produce the above-mentioned highly undesirable condition.

Figure 9:
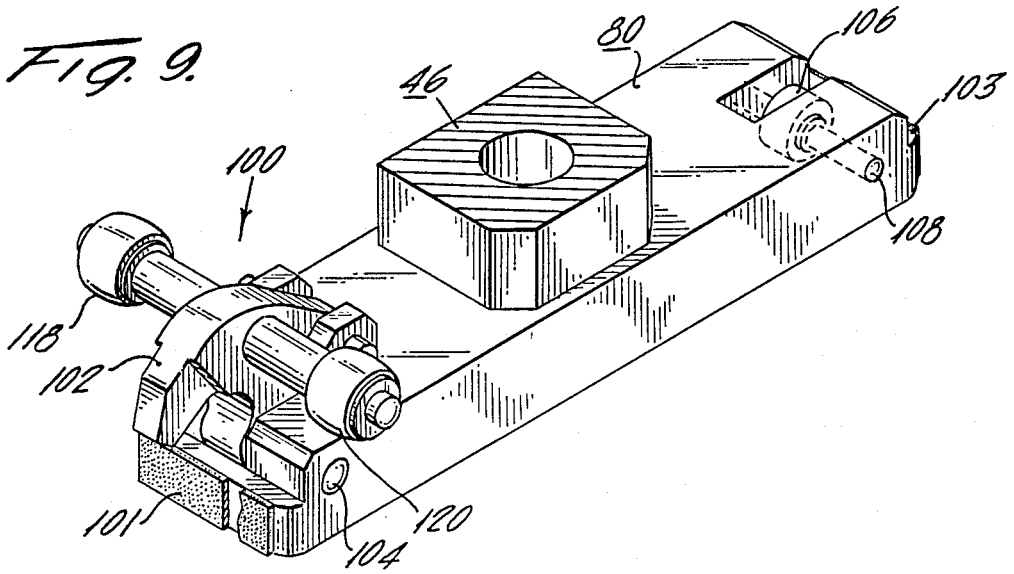
FIG. 9 is a perspective view of the sealing shoe portion of a typical product dispenser.

Referring especially to FIGS. 7 and 9, this problem is overcome by providing, near the bottom of each dispenser cylinder, leading and trailing surfaces such as 98 and 99, which sealingly abut and are clamped to corresponding surfaces of the adjacent cylinders when they are arranged in a straight line and proceeding through the filling zone. By thus automatically clamping together the adjacent surfaces of adjacent sealing shoes, an effective seal is provided to prevent the food product from rising upwardly between the cylinders. When filling is completed, the sealing shoes, hence the dispensers, are unclamped automatically to permit them to turn with respect to each other.

Figure 4:
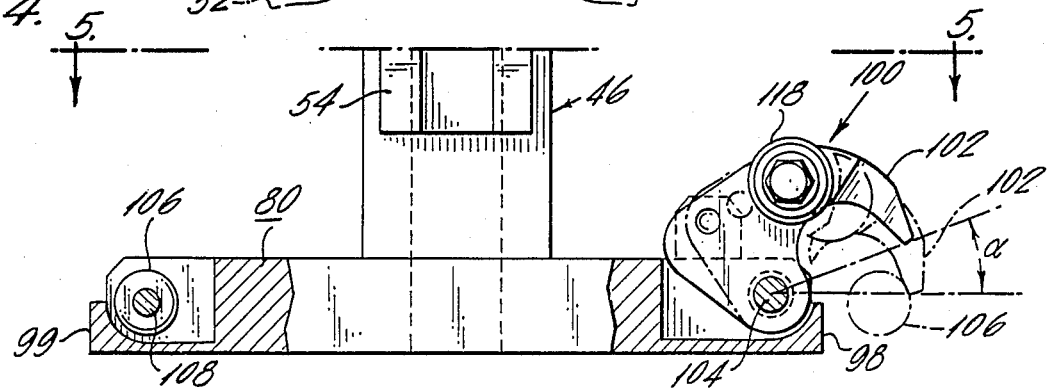

Such clamping together of the sealing shoes at the lower ends of the cylinders as they traverse the feed plate is provided by an automatic latching system comprising latch means such as 100 (FIGS. 4, 5, 7 and 9) provided on the top of each sealing shoe. The latch means comprises, in each case, a latch arm 102 pivoted about an axis such as 104, and a latching wheel 106 rotatable about an axis 108. The latch arm 102 is mounted near the leading end of the block and the latching wheel 106 is positioned near the trailing end of the block, in this embodiment. The latch means is so configured that when it is in the open, or unlatched, position (shown in full line in FIG. 4, and at the right of FIG. 7), obtained by pivoting the latch arm counterclockwise in FIG. 4 (clockwise in FIG. 7), the arm is disengaged from the latching wheel and the dispensers are free of each other; when the latch is rotated in the opposite direction, it extends around and encompasses the latching wheel and, upon further turning, is cammed into a position in which it clamps the end surface of the trailing shoe tightly against the adjacent end surface of the leading shoe, as shown in FIG. 7.

Such automatic latching and unlatching of the latch means are provided by the cam arrangements shown in FIG. 7. A pair of latching cam rails 110 and 112 are placed above and adjacent the path of the dispensers, starting just upstream of the input end of the straight run containing the feed slot and ending just downstream of the feed slot. Each latch arm carries a pair of outrigger cam follower rollers such as 118, 120, one disposed directly below a different corresponding one of the two cam rails 110 and 112. As each pair of rollers reaches the latching cam rails, its latch arm is rotated so as to latch itself around the latching wheel on the sealing shoe ahead of it, and thereby clamps together tightly the adjacent parallel surfaces of adjacent sealing shoes.

Figure 6:
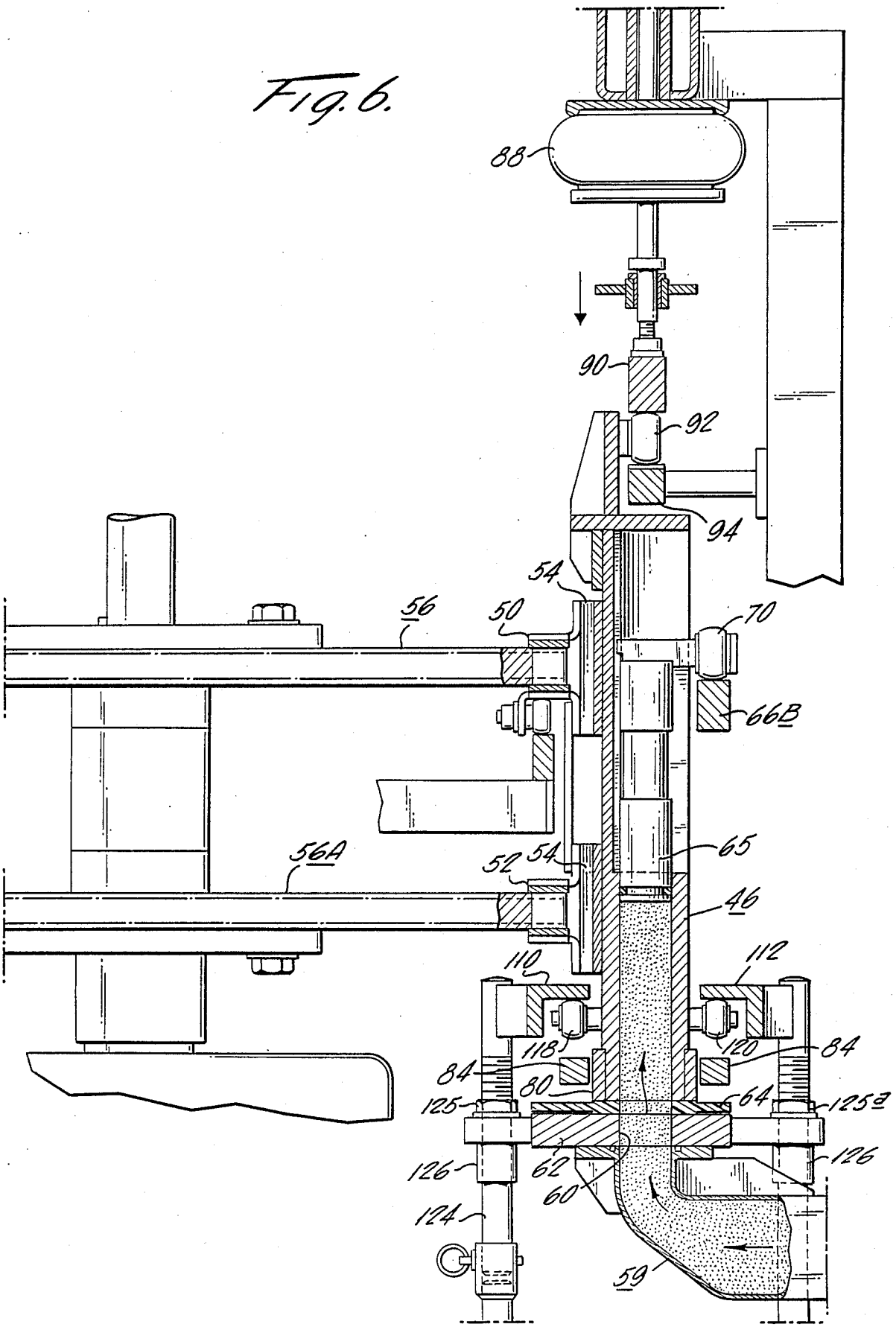
FIG. 6 is an enlarged fragmentary, vertical sectional view taken on lines 6—6 of FIG. 3, showing a typical product dispenser and its mounting and biasing arrangement.
Figure 8:
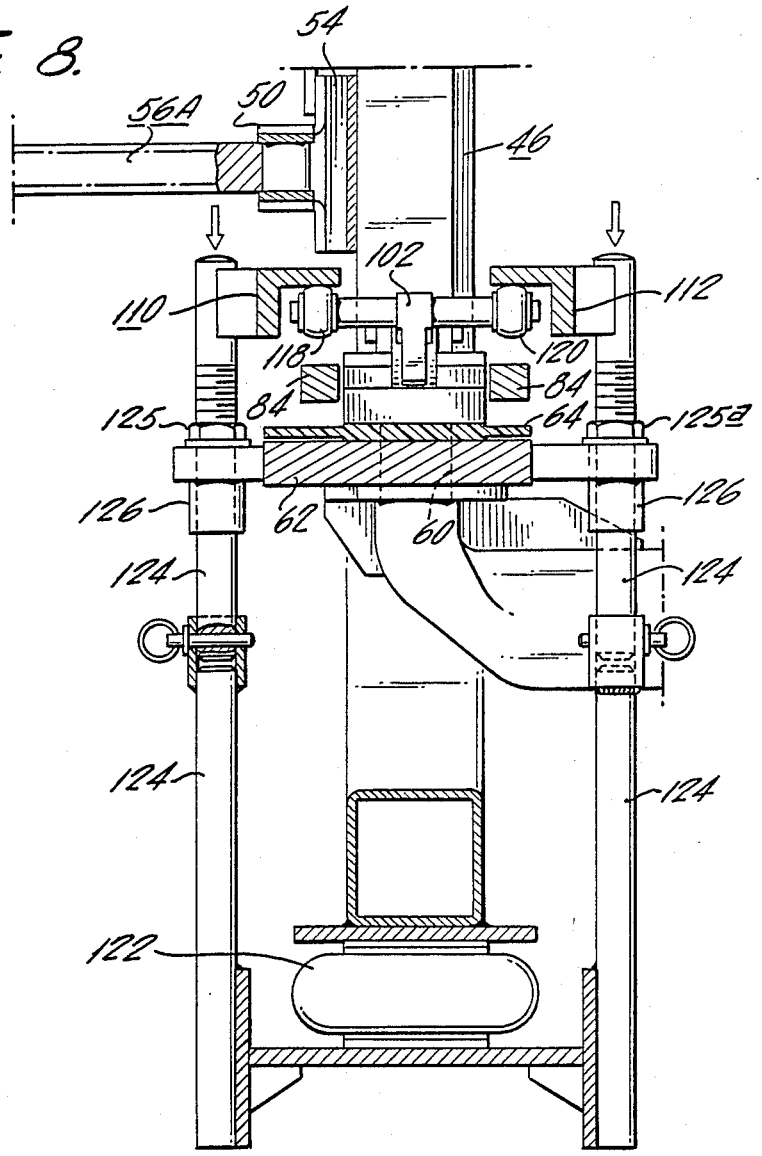
FIG. 8 is a vertical sectional view taken along lines 8—8 of FIG. 7.

To provide a strong camming force for this purpose, the latching cam rails 110,112 are preferably spring-biased downwardly, in this case by air springs such as 122 located beneath the feed plate and acting to urge downwardly the vertical risers such as 124 which pass through bushings such as 126 and are secured to the latching cam rails 110,112 as shown in FIGS. 6, 7 and 8. Nut stops 125,125A limit the maximum preselected downward travel of the risers and of the latching cam rails 110,112. In this way, product is prevented from flowing upwardly between adjacent sealing shoes.

At a position downstream of the feed slot 60 is located the unlatching cam means 140, which presents an inclined plane facing the on-coming latch arm rollers, and serving to pivot the latch arms clockwise as viewed in FIG. 7, unlatching them from their corresponding latching wheels. This permits the sealing shoes and associated dispensers thereafter to be free of each other, until they have traversed the loop and arrived again at the latching cam just upstream of the filling station.

There has therefore been provided a new and useful system in which a series of product dispensers are moved around an endless loop and, during part of their orbit, are moved in a straight line above corresponding containers moving in a straight-line train beneath them, so that product can be discharged as the dispensers move along above the moving containers; filling of the dispensers with food product is accomplished on the opposite straight run of the conveyor which carries the dispensers, and undesired feeding of the product upward from a chamber below the feed slot and between the cylinders is prevented by means which automatically clamp the lower ends of the cylinders sealingly to each other as they traverse the feed slot, and then automatically unclamp them so that they can rotate as is necessary for them to traverse the endles loop.

In the version shown in FIG. 9, seal surfaces are provided by resilient pads 101 and 103 secured to the ends of the sealing shows, to provide a good sealing action. In other embodiments the dispenser conveyor loop may be of different configurations than is shown, and the filling and dispensing mechanisms may also both be very different from the mechanisms depicted and described, so long as said dispensers are automatically clamped to each other during filling and automatically unclamped after said filling.

The sealing surfaces may be curved or irregular rather than flat so long as the surfaces mate to provide a good seal. The sealing surfaces may also be of magnetic material attracting them to each other, or may constitute resilient pads beneath which such attracting magnetic material is placed to enhance the seal.

While the invention has been described with particular reference to specific embodiments thereof, in the interest of complete definiteness, it will be understood that it may be embodied in a vareity of forms diverse from those specifically shown and described, without departing from the spirit and scope of the invention as defined by the appended claims.

We claim:

1. A system for dispensing product into containers moving in a series train along a substantially straight-line path, comprising:

a set of product dispensers;

dispenser conveying means for moving said set of product dispensers orbitally about a closed loop having a substantially-straight first portion extending adjacent said substantially straight-line path of said containers;

dispenser filling means disposed along a second portion of said closed loop for delivering product into said product dispensers, said second portion of said closed loop having an inlet end to which said product dispensers are delivered by said conveying means and an exit end at which said product dispensers leave said second portion of said closed loop;

dispenser actuating means for actuating said dispensers as they travel along said substantially-straight first portion of said closed loop, to dispense product from said dispensers into said containers;

said dispenser filling means comprising a source of product and means for causing said product to flow from said source into said containers, said filling means also tending undesirably to cause said product to flow into any space between said dispensers as they travel along said second portion of said closed loop; and means for automatically sealing each of said dispensers to its neighbors as they travel along said second portion of said loop, and for automatically unsealing each of said dispensers from each other after they have been filled by said filling means and before they reach said substantially-straight first portion of said loop, thereby to minimize flow of said product between said dispensers.

2. The system of claim 1, wherein:

said means for sealing and unsealing each of said dispensers from its neighbors comprises automatic clamping and unclamping means for clamping said dispensers against each other to accomplish said sealing, and for unclamping them to accomplish said unsealing;

said source of said product is positioned along and beneath said second portion of said loop and has a top opening for feeding said product into the lower ends of said dispensers as they travel over said opening, the lower ends of said dispensers being open to receive said product from said opening;

each of said dispensers has a lower sealing portion configured to fit sealingly against that of its neighbor when they are clamped together, said sealing portions being configured to permit said dispensers to pivot with respect to each other as they encounter changes in curvature of said loop;

said means for automatic clamping and unclamping comprises first means disposed along said second portion of said loop for automatically actuating said clamping and unclamping means to clamp said portions of adjacent dispensers sealingly to each other at the entrance end of said second portion of said loop; and second means disposed along said loop adjacent the exit end of said second portion thereof for releasing said clamping and unclamping means to free said adjacent sealing portions thereof from each other.

3. The system of claim 2, wherein said clamping and unclamping means comprise pivotable latch means and latch-engaging means secured to each of said dispensers so that the latch means of each dispenser can be moved into clamping engagement with the latch-engaging means of an adjacent dispenser, wherein said first means for automatically actuating said clamping and unclamping means comprises first cam means positioned adjacent said inlet end of said second portion of said path for pivoting said latch means of each dispenser into clamping engagement with said latch-engaging means of an adjacent dispenser, and said second means for releasing said clamping and unclamping means comprises second cam means positioned adjacent said exit end of said second portion of said path for pivotting said latch means to disengage it from said latch-engaging means.

4. The system of claim 3, comprising means for urging said dispenser means downwardly against said source of product to cover said opening sealingly while traversing said opening, wherein each of said dispensers comprises a vertical cylinder containing a verticlly-reciprocable piston, and wherein said system comprises means for raising said pistons in said cylinders as said cylinders pass over said opening to fill said cylinders with a predetermined quantity of said product, and means for lowering said pistons as said cylinders travel along said first straight portion of said loop to fill said containers.

5. A system for dispensing product into a train of containers moving along a substantially straight-line path, comprising:

a conveyor moving in a closed horizontal loop consisting of two parallel, horizontally-spaced apart straight-line sections joined at their ends by a pair of semi-circular sections, one of said straight-line sections extending parallel to and adjacent said substantially straight-line path;

a plurality of product dispensers mounted on said conveyor to move around said closed loop;

a product supply station for delivering product into said dispensers as they move along the other of said straight-line sections of said loop;

each of said dispensers being free to rotate with respect to its neighbors about a vertical axis passing through it, as it passes between either of said straight-line sections and either of said semi-circular sections;

said product supply station tending undesirably to deliver product into any space between successive ones of said dispensers as they pass through said station;

clamping means for automatically clamping said dispensers to each other as they pass through said product supply station, thereby to prevent delivery of said product into space between said dispensers; and unclampng means for automatically unclamping said dispensers from each other after they have passed through said product supply station and before they leave said other straight-line section of said loop, thereby to permit them to rotate about their respective vertical axes.

6. The system of claim 5, wherein;

said product supply station comprises a source of said product, a feed plate extending over said source of product, and a feed opening through said plate for said product, the lower ends of said dispensers being open and sliding along on said feed plate and over said feed slot;

each of said dispensers comprises an end surface sealingly matable with the adjacent end surface of an adjacent dispenser so that said end surface of adjacent dispensers provide a fluid seal between said adjacent dispensers when clamped together; and said clamping means comprises a latch arm and a latching keeper on each of said dispensers, so positioned that each latch arm on any one of said dispenser can be pivotted into locking engagement with the latching keeper on an adjacent dispenser to clamp the end surfaces of said adjacent dispensers to each other.

7. The system of claim 6, wherein each of said dispensers comprises a sealing shoe portion; said end surfaces, said latch arms and said latching keeper being located on said sealing shoes.

8. The system of claim 7, wherein said end surfaces are flat and vertical.

* * * * *